US009655182B2

(12) United States Patent
Lochmann et al.

(10) Patent No.: US 9,655,182 B2
(45) Date of Patent: May 16, 2017

(54) OPERATING CIRCUIT FOR AN LED

(71) Applicant: Tridonic GmbH & Co. KG, Dornbirn (AT)

(72) Inventors: Frank Lochmann, Esseratsweiler (DE); Markus Schertler, Hittisau (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 14/787,684

(22) PCT Filed: Apr. 30, 2014

(86) PCT No.: PCT/AT2014/000096
§ 371 (c)(1),
(2) Date: Oct. 28, 2015

(87) PCT Pub. No.: WO2014/176609
PCT Pub. Date: Nov. 6, 2014

(65) Prior Publication Data

US 2016/0081150 A1 Mar. 17, 2016

(30) Foreign Application Priority Data

Apr. 30, 2013 (AT) ..... GM151/2013
Oct. 28, 2013 (AT) ..... GM353/2013

(51) Int. Cl.
*H05B 33/08* (2006.01)

(52) U.S. Cl.
CPC ..... *H05B 33/0818* (2013.01); *H05B 33/08* (2013.01); *H05B 33/0851* (2013.01)

(58) Field of Classification Search
None
See application file for complete search history.

(56) References Cited

U.S. PATENT DOCUMENTS 8,860,319 B2 * 10/2014 Naruo ..... H05B 33/0818 315/186
2006/0170373 A1 * 8/2006 Yang ..... H05B 33/0815 315/209 R (Continued)

FOREIGN PATENT DOCUMENTS

WO 2012045475 A1 4/2012
WO 2012045477 A1 4/2012

OTHER PUBLICATIONS

International Search Report issued in connection with International Application No. PCT/AT2014/000096 on Sep. 26, 2014.

*Primary Examiner* — Douglas W Owens
*Assistant Examiner* — James H Cho
(74) *Attorney, Agent, or Firm* — The H.T. Than Law Group

(57) ABSTRACT

The invention relates to an operating circuit for at least one LED, said operating circuit being supplied with DC voltage or with rectified alternating voltage and providing a supply voltage for at least one LED by means of a coil (L1) and a first switch (S1) clocked by a control/regulation unit (SR). When the first switch (S1) is activated energy is temporarily stored in the coil (L1) and when the first switch (S1) is deactivated said energy is discharged via a diode (D1) and via at least one LED. The control/regulation unit (SR) activates the first switch (S1) when a reactivation condition has been met, and the control/regulation unit (SR) deactivates the first switch (S1) when a deactivation condition has been met. Said reactivation condition and/or deactivation condition can be set in accordance with the current dimming level.

13 Claims, 5 Drawing Sheets

(56) References Cited

U.S. PATENT DOCUMENTS

| | | | | |
|---|---|---|---|---|
| 2009/0273292 | A1 | 11/2009 | Zimmermann | |
| 2011/0199023 | A1* | 8/2011 | Zimmermann | H05B 33/0818 315/297 |
| 2012/0098453 | A1 | 4/2012 | Esaki et al. | |
| 2012/0104958 | A1 | 5/2012 | Zudrell-Koch et al. | |

* cited by examiner

OPERATING CIRCUIT FOR AN LED

The invention relates to an operating circuit with light-emitting diodes as specified in the preamble of claim 1.

TECHNICAL FIELD

In recent years, semiconductor light sources, such as light emitting diodes, have become increasingly relevant for lighting applications. The reason for this is that, inter alia, decisive technical innovations and considerable progress with regard to brightness and also lighting efficiency (luminous power per watt) of these light sources have been achieved. Not least through their comparatively long operating life, light-emitting diodes have been developed into an attractive alternative to conventional light sources such as incandescent or gas-discharge lamps.

PRIOR ART

Semiconductor light sources are sufficiently well known from the prior art and will be abbreviated in the following as LED (light-emitting diode). In the following, this term is intended to include light-emitting diodes made from inorganic materials and also light-emitting diodes made from organic materials. It is known that the light radiation from LEDs correlates with the current flow through the LEDs.

In order to regulate the brightness, LEDs are therefore always operated in a mode in which the current flow through the LED is regulated.

In practice, for the control of an arrangement of one or more LEDs, switching regulators, for example, step-down converters (step-down or buck converters) are used.

In the activated condition of the switch, current flows through the LED arrangement and a coil which is accordingly charged. In the deactivated condition of the switch, the temporarily stored energy in the coil is discharged via the LEDs (free-wheeling phase). The current through the LED arrangement shows a zigzag time characteristic: when the switch is activated, the LED current shows a rising edge; when the switch is deactivated, a falling edge is observed. The mean value over time of the LED current represents the effective current through the LED arrangement and is a measurement for the brightness of the LEDs. With corresponding clocking of the power switch, the mean, effective current can be regulated.

In order to keep the emitted light spectrum as constant as possible during constant operation, the use of a so-called PWM method (pulse-width modulation) is known in order to regulate the brightness of LEDs. In this context, low-frequency pulse packets (typically with a frequency within the range of 100-1000 Hz) with constant current amplitude (averaged over time) are supplied to the LEDs by the operating device. The high-frequency ripple mentioned above is superposed on the current within the pulse packet.

The brightness of the LEDs can now be controlled by varying the activation conditions of the pulse packets; for example, the LEDs can be dimmed down by increasing the time interval between the pulse packets (that is, the activation phase), or by reducing the width of the pulse packets (that is, of the activation phase).

A practical requirement for the operating device is that it can be used in the most flexible and versatile manner possible, for example, independently of how many LEDs are actually to be connected and operated as a load. Furthermore, the load can vary during operation, for example, if one LED fails.

With conventional technologies, the LEDs are operated, for example, in a so-called 'continuous conduction mode' or respectively gap-free operating mode. This method will be explained in greater detail with reference to FIG. 1*a* and FIG. 1*b* (prior art).

In the example shown in FIG. 1*a*, a step-down converter (buck-converter) is shown as the basic circuit for the operation of at least one LED (or several LEDs connected in series), which comprises a first switch S1. The operating circuit is supplied with a DC voltage or respectively a rectified alternating voltage U0.

PRESENTATION OF THE INVENTION

The object of the present invention is to deliver an operating circuit for at least one LED improved by comparison with the prior art for the operation of at least one LED, which improves the regulation of the operation of the luminous element in a simple manner.

This object is achieved according to the invention by the features of the independent claims. The dependent claims develop the central idea of the invention further in a particularly advantageous manner.

According to a first aspect of the invention, the operating circuit for at least one LED is supplied with a DC voltage or a rectified alternating voltage. A supply voltage for at least one LED is provided by means of a coil and a first switch clocked by a control/regulation unit, wherein, with activated first switch, an energy is temporarily stored in the coil, which is discharged via a diode and via the at least one LED when the first switch is deactivated.

The control/regulation unit activates the first switch when a reactivation condition is reached, and the control/regulation unit deactivates the first switch when a deactivation condition is reached. The reactivation condition and/or the deactivation condition is adjustable dependent upon the present dimming level.

The reactivation condition can be the expiry of a deactivation timespan. However, the reactivation condition can also be a voltage monitored in the operating circuit, preferably the voltage in a secondary winding inductively coupled to the coil.

The deactivation condition can be the expiry of an activation timespan. The deactivation condition can be a current monitored in the operating circuit, preferably the current through a measuring resistor (Shunt, RS).

The control/regulation unit can monitor the reaching of the deactivation condition and also the the reaching of the reactivation condition and, dependent upon the latter, can control the first switch S1 accordingly.

A first sensor unit can be present, which generates a first sensor signal dependent upon the current through the first switch, and a second sensor unit can be present which detects the reaching of the de-magnetisation of the coil or the current flow through the LED during the deactivation phase of the first switch and generates a sensor signal, and that the sensor signals are supplied to the control/regulation unit and processed.

In a possible embodiment, the a DC voltage or a rectified alternating voltage is supplied to the operating circuit for at least one LED. By means of a coil and a first switch clocked by a control/regulation unit, the operating circuit provides a supply voltage for at least one LED, wherein, with an activated first switch, an energy is temporarily stored in the coil, which is discharged via a diode and via at least one LED when the first switch is deactivated. A first sensor unit is present which generates a first sensor signal dependent upon the current through the first switch, and a second sensor unit is present which detects the reaching of the de-magnetisation of the coil or the current flow through the LED during the deactivation phase of the first switch and generates a second sensor signal. The sensor signals are supplied to the control/regulation unit and processed, wherein the control/regulation unit reactivates the first switch at the time when the coil is de-magnetised and/or the diode is in the blocking state, wherein the control/regulation unit deactivates the first switch at the time when the current through the first switch exceeds a threshold value. The control/regulation unit compares the averaged current detected through the first switch and with a reference value, and, dependent upon the deviation of the averaged current from the reference value, the control/regulation unit adjusts the threshold value.

The reference value is adjustable dependent upon the present dimming level.

The averaged current can be detected by a low-pass filter at the measuring resistor. The low-pass filter can be isolated during the pulse pause of a low frequency PWM signal by means of a third switch.

A capacitor can optionally be present, which is arranged parallel to the at least one LED, and which maintains the current through the LED during the de-magnetisation phase.

BRIEF DESCRIPTION OF THE PREFERRED EMBODIMENTS

FIG. 1*a* shows a circuit arrangement according to the known prior art;

FIG. 1*b* shows a diagram with the time characteristic of the LED current in the circuit arrangement of FIG. 1*a* (prior art);

FIG. 2*a* shows a first example of an operating circuit (buck) according to the invention for LEDs;

FIG. 2*b* shows a diagram which illustrates time-dependent current characteristics and control signals in the circuit arrangement shown in FIG. 2*a;*

DETAILED DESCRIPTION OF THE PREFERRED EMBODIMENTS

Figure 1A:
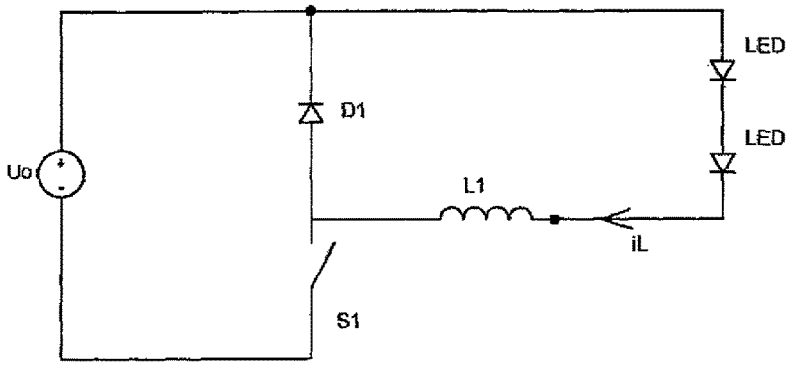
Fig. 1a Prior Art
Figure 1B:
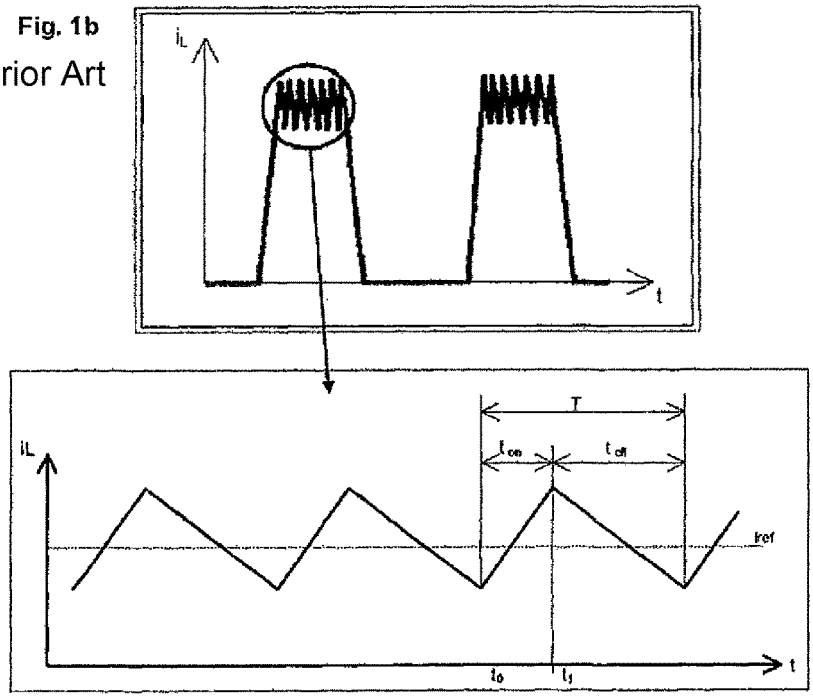
Fig. 1b Prior Art

FIG. 1*a* and FIG. 1*b* show the prior art.

Figure 2A:
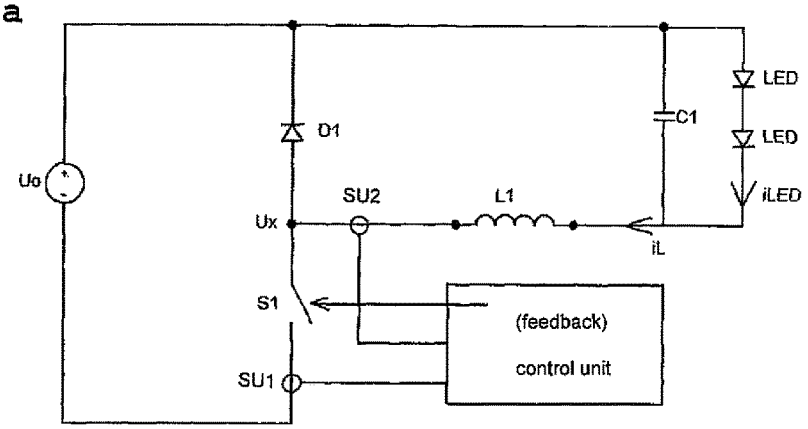

The circuit arrangement illustrated in FIG. 2*a* is an example for a possible operating circuit. It is used for the operation of at least one (or several series-connected and/or parallel-connected) LEDs. In the illustrated example, two LEDs are connected in series by way of example. Of course, only one or more LEDs can also be provided. The LED or respectively the series-connected and/or parallel-connected LEDs are also referred to in the following as an LED pathway.

One advantage of the present invention is that the operating circuit adapts in a very flexible manner to the type and number of series-connected LEDs. A DC voltage U0, which can, of course, also be a rectified alternating voltage, is supplied to the circuit. The LEDs are connected in series to a coil L1 and to a first switch S1.

Furthermore, the circuit arrangement comprises a diode D1 (the diode D1 is connected in parallel to the LEDs and to the coil L1) and optionally a capacitor C1 connected in parallel to the LEDs. In the activated condition of the first switch S1, current flows through the LEDs and through the coil L1, which is magnetised as a result. In the deactivated condition of the first switch S1, the energy temporarily stored in the magnetic field of the coil is discharged in the form of a current via the diode D1 and the LEDs.

In parallel with this, at the beginning of the activation of the first switch S1, provided it is present, the capacitor C1 is charged. During the deactivation phase of the first switch S1 (free-wheeling phase), the capacitor C1 is also discharged and contributes to the current flow through the LED pathway. With an appropriate dimensioning of the capacitor C1, this leads to a smoothing of the current through the LEDs.

A field-effect transistor or also a bipolar transistor can be used as the first switch S1. The first switch S1 is connected in a high-frequency manner, typically in a frequency range above 10 kHz.

One possible embodiment of the circuit is to spare the first switch S1 during operation, because, as described later, it can be activated when the power applied to it is approximately zero. A further possible embodiment of the circuit is, in each case, to use a comparatively less expensive component with comparatively somewhat longer switching duration or longer clearing time for the first switch S1 and the diode D1.

Furthermore, a control and/or regulation unit SR which specifies the clocking of the first switch S1 for the control of the LED power is provided in the circuit of FIG. 2*a*.

As input parameters, the control/regulation unit SR uses signals from a first sensor unit SE1 and/or signals from a second sensor unit SE2 in order to specify the exact activation and output times of the first switch S1.

The first sensor unit SE1 is arranged in series with the first switch S1 and detects the current flow through the first switch S1. The filmier serves to monitor the current flow through the first switch S1. If the current flow through the first switch S1 exceeds a given maximal reference value, the first switch S1 is deactivated. In an alternative embodiment, the first sensor unit SE1 can be, for example, a measuring resistor (Shunt or current measuring resistor).

In order to monitor the current flow, the voltage drop in the measuring resistor (shunt) can now be picked up and compared with a reference value, for example, by means of a comparator.

If the voltage drop in the measuring resistor (Shunt) exceeds a given value, the first switch S1 is deactivated.

The second sensor unit SE2 is arranged within the current branch through which the current flows during the free-wheeling phase. This can be close to or in the coil L1. The second sensor unit SE2 can monitor the current flow through the LED during the deactivation phase of the first switch (that is, the free-wheeling phase), for example, with the assistance of a current measuring resistor connected in series to the LED. With the assistance of the second sensor unit SE2, the control unit/regulation unit SR can specify an appropriate time for the activation time of the first switch S1.

According to an alternative embodiment, the first switch S1 can be activated when the current through the coil L1 is zero for the first time or is at least very low, for example, in the time range when the diode D1 is in the blocking state at the end of the free-wheeling phase. At the activation time of the first switch S1, a minimal possible current can be present in the switch S1. An almost loss-free switching can be achieved by detecting the current zero crossing through the coil L1. The current through the LEDs shows only a slight waviness and does not fluctuate strongly.

This is attributable to the smoothing effect of the capacitor C1 connected in parallel to the LEDs. During the phase of a low coil current, the capacitor C1 takes over the feeding of the LED.

Figure 2B:
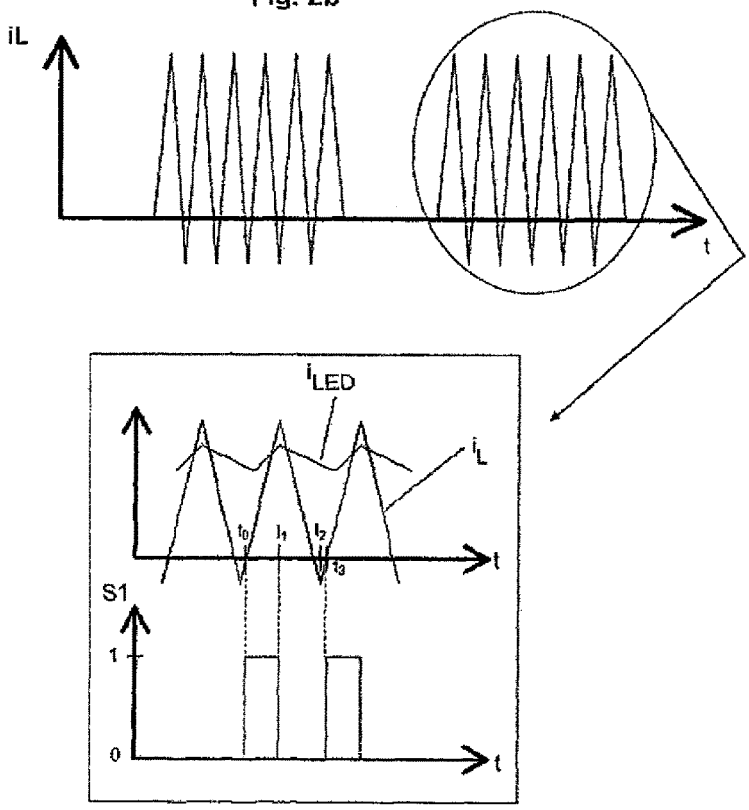

The individual current characteristics and the optimal activation time of the first switch S1 will be explained in greater detail with reference to the diagram in FIG. 2*b*.

By analogy with the diagram in FIG. 1*b*, the time characteristic of the current i_L is shown over two pulse packets.

The enlarged view shows the current characteristic within a low-frequency pulse packet NF PWM (for example, supplied to the operating circuit as a low-frequency pulse signal, wherein the LED is operated correspondingly): the time characteristic of the current i_L through the coil L1, the time characteristic of the current i_LED through the LEDs and the time characteristic of the condition of the first switch S1 are plotted (In condition 0, the first switch S1 is switched off; in condition 1, the switch is closed; the signals for the condition of the switch S1 correspond to the drive signal (that is, in the gate) of the switch S1). At the time t_0, the first switch S1 is closed and a current begins to flow through the LED and the coil L1. The current i_L shows a rise according to an exponential function, wherein a quasi-linear rise of the current i_L is evident in the relevant region here. i_LED differs from i_L in that part of the current i_L contributes to the charging of the capacitor C1.

The opening of the first switch S1 at the time t_1 (for example, when a desired maximal reference value has been reached) leads to the consequence that the energy temporarily stored in the magnetic field of the coil is discharged via the diode D1 and the LEDs or respectively the capacitor C1. The current i_L continues to flow in the same direction, but falls continuously and can even reach a negative value. A negative current (that is, a current flow with reverse direction) is present so long as the charge carriers, which were previously enriched in the diode D1 biased to conduct, have been cleared from the junction of the diode D1.

By contrast, the current i_LED declines only weakly and is maintained, because the capacitor C1 has a smoothing effect. At the time t_2, the diode is in a blocking state. The current i_L declines (but is still negative) and tends towards zero. In this phase, parasitic capacitances in the diode D1 and further parasitic capacitances in the rest of the circuit are reversed.

The voltages at the nodal point Ux above the first switch S1 and in the coil L1 change very rapidly in this time period. The voltage at the nodal point Ux falls to a low value (because of the blocking of the diode D1). An advantageous reactivation time t_3 for the first switch S1 is now given when the current i_L reaches the zero crossing, or at least close to the zero crossing. At this time, the coil L1 is not magnetised or respectively hardly magnetised. The first switch S1 can be activated at this time with a very small losses, because current hardly flows through the coil L1. However, a reactivation is also possible even at time t_2 or shortly before, because the current through the coil L1 within this time range is very small.

A second sensor unit SE2 now serves to detect the advantageous activation time for the first switch S1. For example, in a first embodiment, the current i_L through the coil L1 can be detected. However, this requires relatively effort-intensive circuits. The current i_L through the coil L1 can be detected, for example, by means of a Hall-effect sensor. Additionally or alternatively, further/other parameters can therefore be used which are suitable for the detection of an advantageous activation time.

In a further embodiment, for example, the magnetisation condition of the coil L1 can be detected. The second sensor unit SE2 can be, for example, a secondary winding L2 in the coil L1 which picks up the voltage in the coil L1. The monitoring of the time voltage characteristic in the coil L1 (in particular, the 'dip' shortly after the blocking of the diode D1 after the time t_2) provides information about the advantageous reactivation time of the first switch S1. In a simple variant embodiment, a comparator which can detect the reaching of the de-magnetisation (and therefore the zero crossing) on the basis of the overshooting or respectively falling below of a threshold value, would be sufficient.

Instead of or in addition to the voltage monitoring in the coil L1, for example, the voltage at the nodal point Ux above the first switch S1 can be monitored. With the blocking of the diode, the voltage at the nodal point Ux declines significantly from a high value to a low value. The signal for the reactivation of the first switch S1 can therefore be triggered when the voltage Ux falls below a given threshold value. The control/regulation unit SR reactivates the first switch S1 at the time when the coil L1 is de-magnetised and/or the diode D1 is in a blocking state. In this context, the second sensor unit SE2 can comprise a secondary winding L2 inductively coupled to the coil L1 or a voltage splitter (R1, R2) at the nodal point Ux.

The control/regulation unit SR uses the information from the first sensor unit SE1 and/or from the second sensor unit SE2 to determine the deactivation time and the activation time of the first switch S1. The control of the LED power (averaged over time) by the SR can be implemented, for example, in the form of pulsed signals, for example, PWM signals. The frequency of the pulsed signal is typically disposed in the order of magnitude from 100-1000 Hz.

The control/regulation unit SR can activate the first switch S1 upon reaching a reactivation condition. The control/regulation unit SR can deactivate the first switch S1 upon reaching a deactivation condition. The reactivation condition and/or the deactivation condition can be adjustable dependent upon the present dimming level.

The reactivation condition can be the expiry of a deactivation timespan. Alternatively, the reactivation condition can be a voltage monitored in the operating circuit, preferably the voltage in a secondary winding L2 inductively coupled to the coil L1.

The deactivation condition can be the expiry of an activation timespan. The deactivation condition can be a current monitored in the operating circuit, preferably the current through a measuring resistor Shunt, RS.

A first sensor unit SE1 can be present, which generates a first sensor signal SES1 dependent upon the current through the first switch S1. The first sensor unit SE1 can generate the deactivation condition with the first sensor signal SES1. The deactivation condition can be a current monitored in the operating circuit, preferably the current through a measuring resistor Shunt, RS, which is connected in series to the first switch S1. In this case, the first sensor unit SE1 can be formed by the measuring resistor Shunt, RS, which is connected in series to the first switch S1. The deactivation condition can be the reaching of a deactivation current value for a current monitored in the operating circuit, for example, the current through the LED or the current through the first switch S1.

A second sensor unit SE2 can be present which detects, for example, the reaching of the de-magnetisation of the coil L1 and generates a sensor signal SES2.

The second sensor unit SE2 can also monitor the current flow through the LED during the deactivation phase of the first switch (that is, the free-wheeling phase), for example, with the assistance of a current measuring resistor connected in series to the LEDs. The second sensor unit SE2 can generate the reactivation condition with the second sensor signal SES2. The reactivation condition can be the reaching of the de-magnetisation of the coil L1 or also that of a reaching of an activation current value (in this case, a falling below) for a current monitored in the operating circuit. For example, the current through the LEDs or the current through the coil L1 during the free-wheeling phase, that is, the deactivation phase of the first switch S1, can be monitored. Optionally, for example, if the reaching of the de-magnetisation of the coil L1 is monitored as the reactivation condition, a waiting time can also be optionally inserted, which is adapted dependent upon the dimming level, and accordingly, dependent upon the dimming level, the reactivation condition is not fulfilled immediately upon the detection of the reaching of the de-magnetisation of the coil L1, but only after the expiry of a waiting time specified on the basis of the dimming level.

The sensor signals SES1, SES2 can be supplied to the control/regulation unit SR and processed in the control/regulation unit SR.

The deactivation condition can be raised with an increasing dimming level, and reduced no further in the case of a falling below of a given dimming level.

Alternatively or additionally, the reactivation condition can be raised in the case of an increasing dimming level, and reduced no further in the case of a falling below a given dimming level.

The control/regulation unit SR can monitor the reaching of the deactivation condition and also the reaching of the reactivation condition and, dependent upon this, control the first switch S1 accordingly. For example, value tables for different dimming levels and associated values for the deactivation condition and/or reactivation condition can be stored in the control/regulation unit SR. For example, functions for a computational determination of the respective values for the deactivation condition and/or reactivation condition dependent upon the dimming level can also be stored in the control/regulation unit SR.

A method for the operation of at least one LED, wherein the reactivation condition and/or the deactivation condition can be adjustable dependent upon the present dimming level, is also made possible.

Accordingly, for instance, a mixed dimming operation is made possible. For example, the brightness of the LED at low dimming levels can be adapted both by adapting the pulse-duty factor or by adapting the pulse pause of the low-frequency PWM signal NF PWM and also by adapting the reactivation condition and/or the activation condition dependent upon the present dimming level an adjustment of the mean power or respectively of the mean current through the LED can be implemented and accordingly, the brightness can be adapted. However, it would also be possible, in the case of a falling below of a given dimming level, for the reactivation condition and/or the deactivation condition not to be adapted further, but only for the low-frequency PWM signal NF PWM to be varied. It would also be possible, in the case of an overshooting of a given dimming level, for the reactivation condition and/or the deactivation condition to be adapted, but for the low-frequency PWM signal NF PWM to be varied no further.

Figure 3:
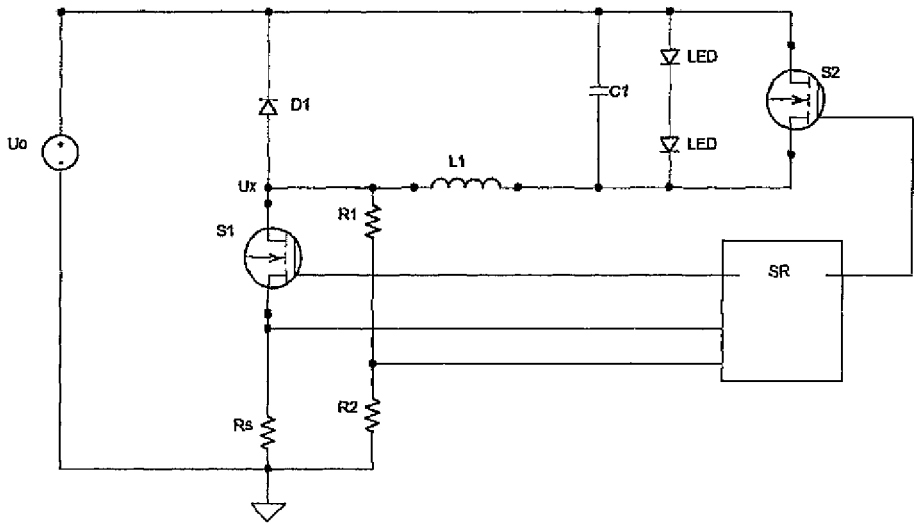
FIG. 3 and FIG. 4 show special embodiments of the invention.
Figure 4:
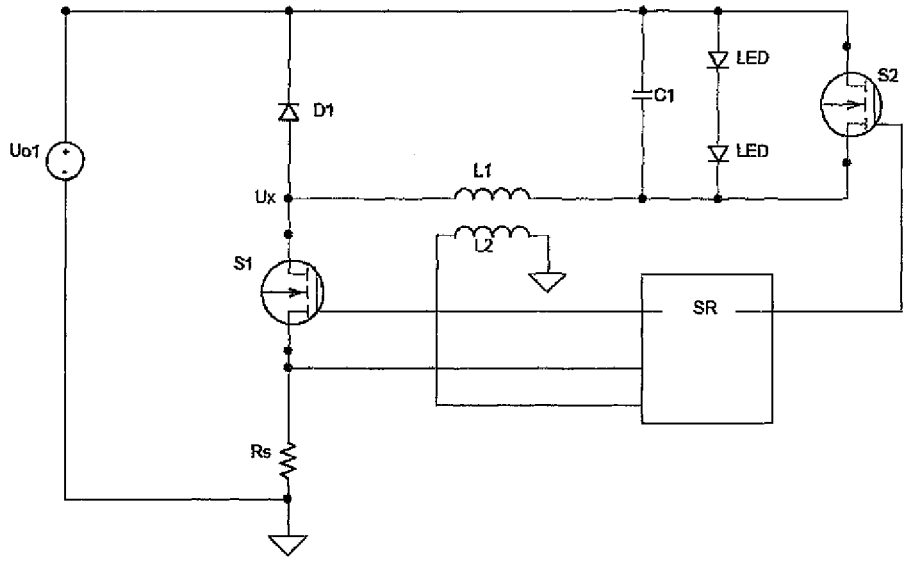

FIG. 3 and FIG. 4 show special embodiments of the invention.

FIG. 3 shows a special embodiment of the switching arrangement described above (of a step-down converter or respectively buck-converter). The advantageous deactivation time in this context is detected by detecting the voltage at the nodal point Ux above the first switch S1. This is implemented by the ohmic voltage splitter R1 and R2. The nodal point Ux is disposed between the coil L1, the diode D1 and the switch S1.

For example, a capacitive voltage splitter or combined voltage splitter which is built up from resistor and capacitor is also possible as the voltage splitter. The measuring resistor (Shunt) RS serves for current detection through the first switch S1. The monitoring of the time voltage characteristic at the nodal point Ux (especially of the 'dip' shortly after the blocking of the diode D1 close to the time t_2) provides information about the advantageous reactivation time of the first switch S1.

Instead of or in addition to a voltage monitoring in the coil L1, for example, the voltage at the nodal point Ux above the first switch S1 can be monitored. With the blocking of the diode, the voltage at the nodal point Ux falls significantly from a high value to a low value. The signal for the reactivation of the first switch S1 can therefore be triggered when the voltage Ux falls below a certain threshold value.

In the circuit arrangement of FIG. 3, a second switch S2 is additionally arranged in parallel to the LEDs and the capacitor C1. The second switch S2 can be controlled in a selective/independent manner and can, for example, be a transistor (MOSFET or bipolar transistor). If the second switch S2 is closed, the discharge process of the capacitor C1 is accelerated. The accelerated discharge of the capacitor C1 means that the current flow through the LED tends towards zero as rapidly as possible. This is desirable, for example, at the end of a low-frequency PWM packet, where the current flow through the LED should fall as rapidly as possible, that is, the falling edge of the current characteristic should be as steep as possible (for reasons of colour constancy).

Alternatively, the second switch S2 can be activated and controlled at a low dimming level, where the low-frequency PWM packets are very short, and it is important that the current through the LEDs moves rapidly towards zero at the end of a pulse packet. For example, an even lower dimming level can be achieved through an appropriate control of the second switch S2.

A further function of this second switch S2 is that, in the activated condition, it bridges the LEDs. This is required, for example, if the LEDs are to be deactivated, that is, are not to emit light, but the supply voltage U0 is still present. Without the bridging through the second switch S2, an (in fact small) current would flow via the LEDs and the resistors R1 and R2 and (slightly) illuminate the LEDs.

It should be noted that the arrangement of a second switch S2 in parallel to the LEDs and the capacitor C1 for the accelerated discharge of the capacitor C1 or respectively for the bridging of the LEDs, is not only restricted to the special embodiment of the circuit arrangement of FIG. 3, but can be used in all embodiments of the invention.

FIG. 4 shows a modification of the circuit in FIG. 3 to the effect that the voltage monitoring takes place in the coil L1. The voltage in the coil S1 can be detected, for example, by means of a secondary winding L2 which is coupled to the coil S1, (or respectively an additional coil L2 which is inductively coupled to the coil L1). A secondary winding L2 now serves for the detection of the advantageous activation time for the first switch S1. The monitoring of the time voltage characteristic at the coil L1 (especially of the 'dip' close to the blocking of the diode D1 after the time t_2) provides information about the advantageous reactivation time of the first switch S1. As already mentioned, this monitoring can also take place on the basis of a secondary winding L2.

As already mentioned, the determination of the time of the zero crossing or respectively of the de-magnetisation can also take place by means of a monitoring of a threshold value (with regard to falling below or overshooting a threshold value; in the case of a monitoring by means of a secondary winding L2, the polarity of the voltage depends upon the direction of winding of the secondary winding L2 relative to the coil L1).

Figure 5:
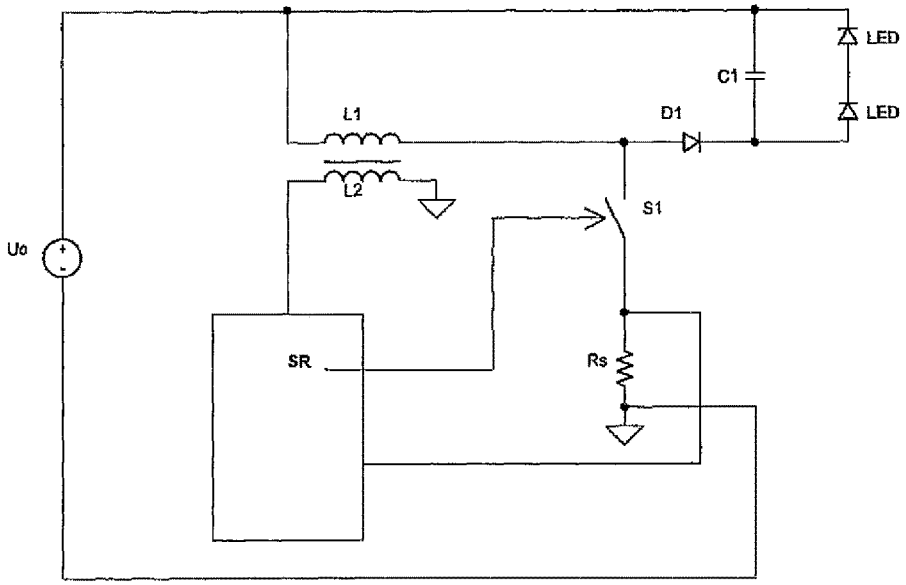
FIG. 5 shows a variation of the circuit from FIG. 2*a* (buck-boost)

It should be noted that the method for detecting an advantageous activation time for the first switch S1 can, of course, also be used in other circuit topologies, for example, for a so-called blocking-oscillator type converter or respectively buck-boost converter or a so-called flow-through converter or respectively forward converter. FIG. 5 shows a modification of the circuit from FIG. 2*a* to the effect that the arrangement of the choke L1, the diode D1 and the orientation of the LED pathway is modified (forms a blocking-oscillator type converter or respectively buck boost converter).

Figure 6:
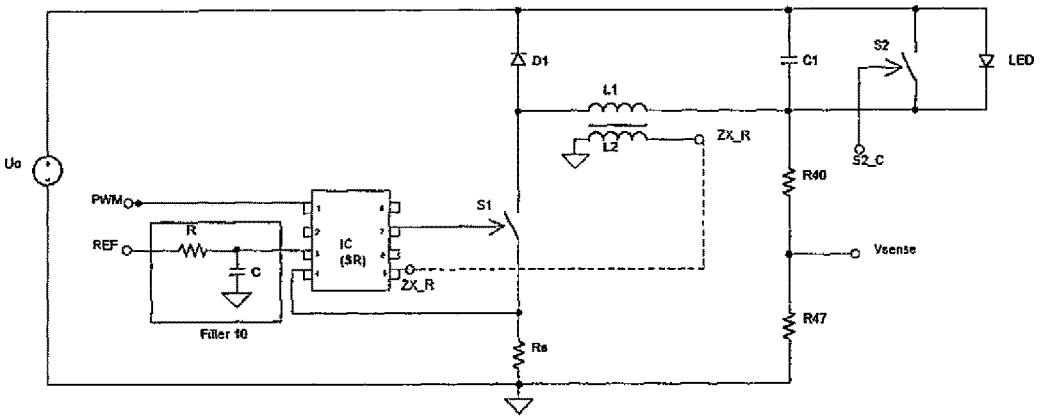
FIG. 6 shows a further special embodiment of the invention.

FIG. 6 shows a further development of the invention. Detecting the reaching of the de-magnetisation of the coil L1 by monitoring the voltage in the winding L2 can be implemented by a conventionally available control circuit IC. This control circuit IC (integrated circuit), which corresponds to or respectively contains the control/regulation unit SR according to FIGS. 2 to 5, comprises an input for detecting the reaching of the de-magnetisation of a coil by monitoring the voltage in a secondary winding applied to the coil. Furthermore, the control circuit IC comprises an output for controlling a switch and further monitoring inputs. A first one of these monitoring inputs can be used to specify a reference value, such as a reference voltage.

A second monitoring input can be used to monitor the reaching of a maximal voltage or, also on the basis of a voltage measurement in a resistor, to monitor the reaching of a maximal current. A third monitoring input can be used to monitor a further voltage or also for the activation and deactivation of the control circuit IC or of the control of the switch controlled by the control circuit IC.

As shown in FIG. 6, the control circuit IC monitors the current through the first switch S1 during the activation phase of the first switch S1 via the measuring resistor (Shunt) Rs and the input 4 in the control circuit IC. As soon as the voltage, which is picked up via the measuring resistor (Shunt) Rs, reaches a given maximal value, the first switch S1 is opened. The specification of the level of the voltage required to open the first switch S1 can be adapted by specifying a reference value (that is, a reference voltage) at the input 3 of the control circuit IC. For example, a reference voltage can be specified by a microcontroller, which specifies the level of the maximum voltage permitted via the measuring resistor (Shunt) Rs and accordingly the maximal current permitted through the first switch S1.

For instance, the microcontroller can output a PWM signal, which is then smoothed by a filter 10 (for example, an RC element) and is accordingly present as a DC voltage signal with a given amplitude at the input of the control circuit IC. By varying the pulse-duty factor of the PWM signal of the microcontroller, the amplitude of the signal at the input of the control circuit IC can be adapted.

The control circuit IC can detect the reaching of the de-magnetisation of the coil L1 on the basis of the monitoring of the voltage in a secondary winding L2 applied to the coil L1. This detection can be used as a reactivation signal. As soon as the de-magnetisation of the coil L1 has been detected by the control circuit IC, the control circuit IC can activate the first switch S1 through a control via the output 7.

The control circuit IC can be activated and/or also deactivated by applying a voltage at the input 1. This voltage for the activation at the input 1 can also alternate between a high-level and low-level, wherein the control circuit IC is activated in the case of a high level, and at least interrupts the control of the first switch S1 in the case of a low-level. This control of the input 1 can be implemented by a microcontroller. For example, in this manner, a low-frequency activation and deactivation of the control circuit IC and accordingly of the control of the first switch S1 can be achieved, and accordingly, the low-frequency control of the operating circuit for dimming the LED.

Furthermore, a further reference voltage for the control circuit IC can also be specified through the input 1, via the amplitude of the signal present at this input. For example, this voltage can also influence the level of the maximal permitted current through the switch or also the permitted activation duration of the first switch S1. The control circuit IC and/or the control circuit IC combined with the microcontroller can jointly form the control unit SR.

The activation duration of the first switch S1 can also be dependent upon a further voltage measurement within the operating circuit. For example, a voltage measurement Vsense can also be supplied to the control circuit IC.

A monitoring or also a measurement of the voltage at the nodal point between the coil L1 and LED can also take place via this voltage measurement, for example, through a voltage splitter R40/R47. This voltage measurement Vsense can be supplied either additively to a further input of the control circuit IC, as an additional value to an already occupied input of the control circuit IC, or also to an input of the microcontroller.

Accordingly, a system can be built up, which achieves, on the one hand, a simple control for the dimming of LEDs through low-frequency PWM, and, on the other hand, a minimal possible loss, high-frequency operation of the operating device combined with a maximal possible stability of current through the LED.

The frequency and also the pulse-duty factor of a low-frequency PWM signal for the dimming of LEDs can be specified by a microcontroller, but alongside this, the level of the maximal permitted current through the first switch S1 can also be specified. The microcontroller can control the dimming of the LEDs through low-frequency PWM via a signal which is conducted to the input 1 of the control circuit IC. Furthermore, the microcontroller can also specify the level of the maximal permitted current through the first switch S1 or also the necessary activation duration of the first switch S1 via a signal which is conducted to the input 3 of the control circuit IC.

The operating circuit can also contain a further switch S2 which is arranged in such a manner that this second switch S2 can bridge the LED.

The second switch S2 can also be arranged in such a manner that it can take over the current from the LED through an existing high-ohmic voltage measurement pathway or a similar existing high-ohmic circuit arrangement, or can interrupt the latter.

Through parallel configuration of the second switch S2 with the LED, the former can bridge and therefore deactivate the LED. This method can be used to adjust the brightness (dimming) of the LED. A possible variant would be that the dimming takes place via the second switch S2, while only the current through the LED is adjusted and regulated via the control of the first switch S1.

However, the control of the two switches S1 and S2 can also be used in a combined manner for an optimised dimming control. Accordingly, for example, the second switch S2 can be used additionally only for dimming to low dimming levels. Because of the existing topology and the regulating circuit, the operating circuit is designed in such a manner that the output voltage of the operating circuit (that is, the voltage across the LED) is limited to a maximal permitted value. If the LED is bridged by closing the second switch S2, the operating circuit then limits the output voltage in such a manner that no excessive current which could lead to possible destruction can flow. This control of the second switch S2 can be used, for example, for dimming only at a low dimming level.

If the step-down converter (buck-converter) is fixed to operate in the power-source operating mode (in the so-called hysteresis mode, as described in the exemplary embodiments) and to run efficiently, the LED can be dimmed only with the second switch S2, which should be very low-ohmic, but the losses are nevertheless low.

Additionally, the second switch S2 can be controlled in such a manner that it can take over the current from the LED through an existing high-ohmic voltage measurement pathway or a similar existing high-ohmic circuit arrangement.

If, for example, as shown in FIG. 6, the first switch S1 is not clocked, no current should flow through the LED. Because of the existing voltage splitter R40/R47, however, a small current can flow through the LED. In this case, with a desired deactivation of the LED (for example, if no light is to be emitted), the second switch S2 can be closed, so that the current flow through the LED is interrupted or prevented.

The second switch S2 can at least always be controlled in connection with a low-frequency PWM packet in order to bridge or respectively deactivate the LED (during the last discharge edge, that is, at the end of a low-frequency PWM pulse packet).

An interruption of the current through the LED can also be implemented through an arrangement of the second switch S2 in series with the LED.

The example of FIG. 6 (and, of course, also the others) can be extended to the effect that several operating circuits according to FIG. 6 are present. The control circuits IC or respectively the control units SR of the individual operating circuits are controlled from a common microcontroller. The individual operating circuits can control, for example, LED strings of different wavelength or colour. The control of the microcontroller can be implemented via an interface (wireless or tethered).

In this context, control signals for adjusting the brightness or colour or also status information can be transmitted via the interface.

Figure 7:
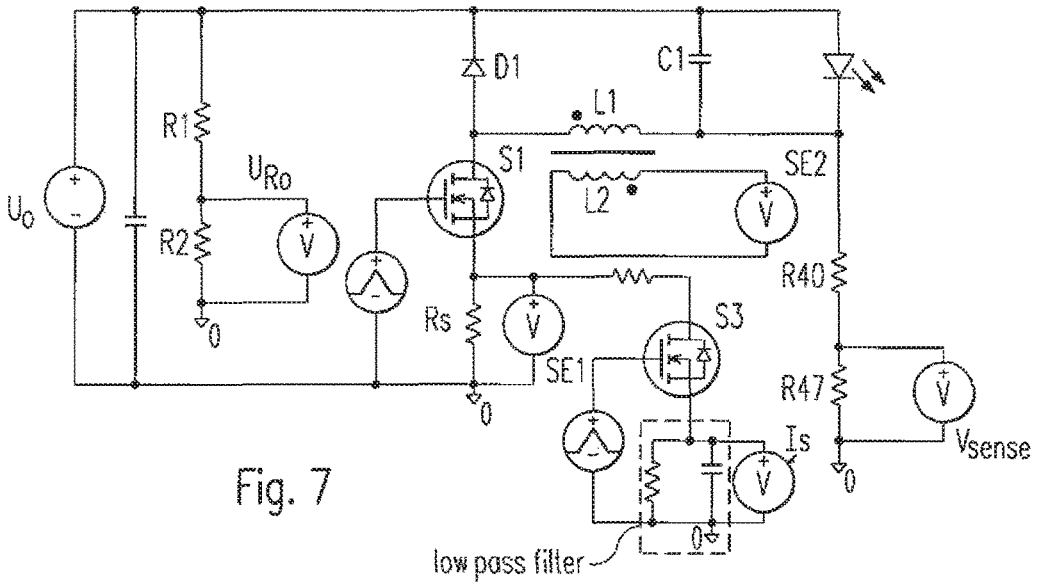
FIG. 7 shows a further special embodiment of the invention.

In FIG. 7 shows a circuit arrangement—inter alia—a step-down converter (buck-converter) for the operation at least of the LED pathway (with one or more LEDs connected in series), with a first switch S1 which can also be designated as a converter switch of the buck-converter. The circuit arrangement, also referred to in the following as the operating circuit, is supplied with a DC voltage or respectively a rectified alternating voltage $U_0$. The voltage $U_{R0}$ can be measured via the voltage splitter R1 and R2, so that the DC voltage or respectively a rectified alternating voltage $U_0$ can be inferred, and, with the assistance of the averaged current $I_S$, the power of the circuit arrangement can be determined.

The switch current through the first switch S1 can be detected in the measuring resistor RS, for example, by the control/regulation unit SR.

The further exemplary embodiment shown in FIG. 7 also relates to an operating circuit for at least one LED to which a DC voltage or a rectified alternating voltage is supplied. By means of a coil L1 and a first switch S1 clocked by a control/regulation unit SR, the operating circuit supplies a supply voltage for at least one LED. With an activated first switch S1, an energy is temporarily stored in the coil L1, which is discharged via a diode D1 and at least one LED when the first switch S1 is deactivated. A capacitor C1, which is arranged in parallel to the at least one LED and which maintains the current through the LED during the phase of the de-magnetisation of the coil L1, can optionally be present.

A first sensor unit SE1 which generates a first sensor signal SES1 dependent upon the current through the first switch S1 can also be present. A second sensor unit SE2 which detects the reaching of the de-magnetisation of the coil L1 and generates a sensor signal SES2 can also be present. The sensor signals SES1, SES2 can be supplied to the control/regulation unit SR and processed, wherein the control/regulation unit SR reactivates the first switch S1 at the time when the coil L1 is de-magnetised and/or the diode D1 is in a blocking state. The control/regulation unit SR deactivates the first switch S1 at the time when the current through the first switch S1 overshoots a threshold value. The control/regulation unit SR detects the averaged current ($I_s$_averaged) through the first switch S1 and compares the latter with a reference value, and, dependent upon the deviation of the averaged current ($I_s$_averaged) from the reference value, the control/regulation unit SR adjusts the threshold value. The reference value is adjustable dependent upon the present dimming level.

The averaged current ($I_s$_averaged) can be detected by a low-pass filter (TPF) at the measuring resistor Rs. The low-pass filter (TPF) can be isolated by means of a third switch S3 during the pulse pause of the low-frequency PWM signal NF PWM.

The threshold value SW of the operating circuit is raised, for example, with an increasing dimming level.

In the case of an overshooting of a given dimming level, the threshold value SW of the operating circuit can be raised no further.

The threshold value SW is raised with an increasing dimming level. This raising of the threshold value SW in the case of an increase of the dimming level can be raised in a non-linear manner. A variation according to a specified non-linear transmission function is implemented via the dimming curve.

Below a given dimming level, the clocking of the first switch S1 is interrupted for a given period, wherein this period is lengthened with a decreasing dimming level.

The clocking of the first switch S1 is interrupted for a given period, wherein, in the case of an overshooting of a given dimming level, this period is reduced no further.

Within a given dimming-level range, the clocking of the first switch S1 is interrupted for a given period, wherein this period is lengthened with a decreasing dimming level, and at the same time, the threshold value SW is lowered with a decreasing dimming level.

Below a given dimming-level range, the clocking of the first switch S1 is interrupted for a given period, wherein, in the case of a lowering of the dimming level, this period is lengthened in a non-linear manner. A variation according to a specified non-linear transmission function is implemented via the dimming curve.

The control unit SR uses a signal SES1 of the first sensor unit SE1 or a signal SES2 of the second sensor unit SE2 or a combination of a signal SES1 from the first sensor unit SE1 and a signal SES2 from the second sensor unit SE2 to determine an activation time and a deactivation time of the first switch S1.

The first switch S1 is deactivated when the current through the first switch S1 overshoots a maximal reference value.

The first sensor unit SE1 can be a measuring resistor Shunt RS.

The second sensor unit SE2 can comprise a secondary winding L2 inductively coupled to the coil L1.

The second sensor unit SE2 detects the reaching of the de-magnetisation of the coil L1 by monitoring the voltage Ux at the nodal point between the first switch S1 and the coil L1.

The control circuit IC can comprise an input for detecting the reaching of the de-magnetisation of a coil L1 and can control a first switch S1.

By applying a voltage to an input of the control circuit IC, a microcontroller can activate and/or deactivate the latter and specify a reference voltage for the control circuit IC at another input.

In a similar manner to the preceding examples, a further example relates to an operating circuit for at least one LED, to which a DC voltage or a rectified alternating voltage is supplied. By means of a coil L1 and a first switch S1 clocked by a control/regulation unit SR, a supply voltage for at least one LED can be provided, wherein, with an activated first switch S1, an energy is temporarily stored in the coil L1, which is discharged via a diode D1 and via at least one LED when the first switch S1 is deactivated. A capacitor C1 can optionally be present, which is arranged in parallel with the at least one LED, and which can maintain the current through the LED during the phase of the de-magnetisation of the coil L1. A first sensor unit SE1 which generates a first sensor signal SES1 dependent upon the current through the first switch S1 can be present. A second sensor unit SE2 which detects the reaching of the de-magnetisation of the coil L1 and generates a sensor signal SES2 can be present. The sensor signals SES1, SES2 can be supplied to the control/regulation unit SR and processed. The control/regulation unit SR can reactivate the first switch S1 at the time when the coil L1 is de-magnetised and/or the diode D1 is in a blocking state.

The control/regulation unit SR can deactivate the first switch S1 at the time when the current through the first switch S1 overshoots a threshold value SW, and the threshold value SW can be adjustable dependent upon the present dimming level.

Alternatively, as a further example, an operating circuit is proposed for at least one LED, to which a DC voltage or a rectified alternating voltage is supplied and which provides a supply voltage for at least one LED by means of a coil L1 and a first switch S1 clocked by a control/regulation unit SR. With an activated first switch S1, an energy is temporarily stored in the coil L1, which is discharged via a diode D1 and at least one LED when the first switch S1 is deactivated. The control/regulation unit SR can activate the first switch S1 when a reactivation condition is reached. The control/regulation unit SR can deactivate the first switch S1 when a deactivation condition is reached. The reactivation condition and/or the deactivation condition can be adjustable dependent upon the present dimming level.

The reactivation condition can be the expiry of a deactivation timespan. Alternatively, the reactivation condition can be a voltage monitored in the operating circuit, preferably the voltage in a secondary winding L2 inductively coupled to the coil L1.

The deactivation condition can be the expiry of an activation timespan.

The deactivation condition can be a current monitored in the operating circuit, preferably the current through a measuring resistor Shunt, RS.

A first sensor unit SE1 which generates a first sensor signal SES1 dependent upon the current through the first switch S1 can be present. The first sensor unit SE1 can generate the deactivation condition with the first sensor signal SES1. The deactivation condition can be a current monitored in the operating circuit, preferably the current through a measuring resistor Shunt RS which is connected in series to the first switch S1. In this case, the first sensor unit SE1 can be fanned by the measuring resistor Shunt, RS, which is connected in series to the first switch S1. The deactivation condition can be the reaching of a deactivation current value for a current monitored in the operating circuit, for example, the current through the LED or the current through the first switch S1.

A second sensor unit SE2 which detects, for example, the reaching of the de-magnetisation of the coil L1 and generates a sensor signal SES2, can be present. The second sensor unit SE2 can also monitor the current flow through the LED during the deactivation phase of the first switch (that is, the free-wheeling phase), for example, with the assistance of a current measuring resistor connected in series to the LED. The second sensor unit SE2 can generate the reactivation condition with the second sensor signal SES2.

The reactivation condition can be the reaching of the de-demagnetisation of the coil L1 or also that of a reaching of an activation current value (in this case a falling below) for a current monitored in the operating circuit. For example, the current through the LED or the current through the coil L1 during the free-wheeling phase, that is, the deactivation phase of the first switch S1, can be monitored.

The sensor signals SES1, SES2 can be supplied to the control/regulation unit SR and processed in the control/regulation unit SR.

The deactivation condition can be raised with an increasing dimming level, and, in the case of a falling below of a given dimming level, can be reduced no further.

Alternatively, the reactivation condition can be raised in the case of an increasing dimming level and can be reduced no further in the case of a falling below of a given dimming level.

A method for the operation of at least one LED, wherein the reactivation condition and/or the deactivation condition can be adjustable dependent upon the present dimming level, is also made possible.

Figure 8:
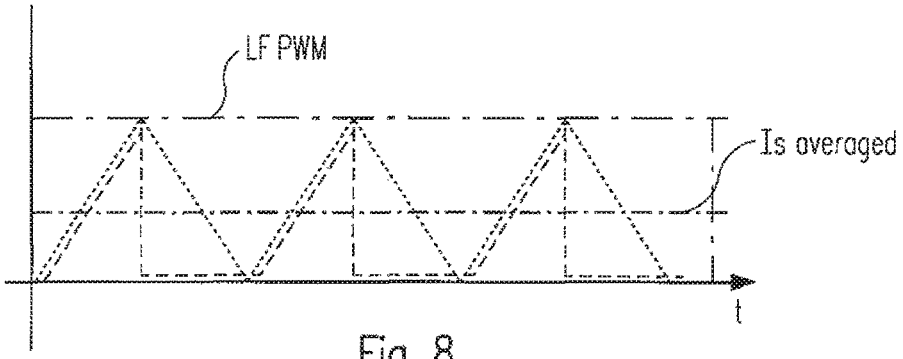
FIG. 8 shows a diagram which illustrates time-dependent current characteristics and control signals in the circuit arrangement illustrated in FIG. 7.

FIG. 8 shows, by way of example, the current $I_S$ through the first switch S1, the averaged current $I_S$ which is determined by the low-pass filter TPS, the current characteristic ILbuck in the coil L1 and a low-frequency PWM signal NF PWM (as low-frequency pulse packet). The low-frequency PWM signal NF PWM is a low-frequency pulse signal, wherein the deactivation phase of this signal determines the given period in which the first switch S1 is not clocked, but its clocking is interrupted.

In a further embodiment, a method for at least one LED is made possible, to which a DC voltage or a rectified alternating voltage is supplied and which provides a supply voltage for at least one LED by means of a coil L1 and a first switch S1 clocked by a control/regulation unit SR, wherein, with an activated first switch S1, an energy is temporarily stored in the coil L1, which is discharged via a diode D1 and via at least one LED when the first switch S1 is deactivated, wherein a capacitor C1 is optionally present, which is arranged in parallel to the at least one LED, and which maintains the current through the LED during the phase of the de-magnetisation of the coil L1. A first sensor unit SE1 generates a first sensor signal SES1 dependent upon the current through the first switch S1. A second sensor unit SE2 detects the reaching of the de-magnetisation of the coil L1 and generates a sensor signal SES2. The sensor signals SES1, SES2 are supplied to the control/regulation unit SR and processed there, wherein the control/regulation unit SR reactivates the first switch S1 at the time when the coil L1 is de-magnetised and/or the diode is in a blocking state, wherein the control/regulation unit SR deactivates the first switch S1 at the time when the current through the first switch S1 overshoots a threshold value SW, and the threshold value SW is adjustable dependent upon the present dimming level.

The present dimming level can be supplied, for example, as an externally specified set brightness value, to the operating device, especially, via a tethered or wireless interface. The present dimming level can also be specified on the basis of a measurement of a sensor, for example, of a brightness sensor, wherein this dimming level can be adjusted, for example, by the operating device, dependent upon the detected environmental brightness.

The invention claimed is:

1. An operating circuit for at least one LED to which a DC voltage or a rectified alternating voltage is supplied and which provides a supply voltage for the at least one LED by means of a coil (L1) and a first switch (S1) clocked by a control/regulation unit (SR), wherein, when the first switch (S1) is activated, an energy is temporarily stored in the coil (L1), being discharged via a diode (D1) and via the at least one LED when the first switch (S1) is deactivated, wherein the control/regulation unit (SR) activates the first switch (S1) when a reactivation condition is reached, wherein the control/regulation unit (SR) deactivates the first switch (S1) when a deactivation condition is reached, characterised in that the control/regulation unit (SR) is configured to adjust the reactivation condition and/or the deactivation condition for the first switch (S1) dependent upon a present dimming level wherein the deactivation condition is reached by monitoring a current in the operating circuit, preferably the current through a measuring resistor (Shunt, RS), and wherein below a given dimming level range, the control unit (SR) interrupts the clocking of the first switch (S1) for a given period, wherein this period is lengthened in a non-linear manner with a decreasing dimming level.

2. The operating circuit according to claim 1, characterised in that the reactivation condition is the expiry of a deactivation timespan.

3. The operating circuit according to claim 1, characterised in that the deactivation condition is the expiry of an activation timespan.

4. The operating circuit according to claim 1, characterised in that the reactivation condition is reached by monitoring a voltage in the operating circuit, preferably the voltage in a secondary winding (L2) inductively coupled to the coil (L1).

5. The operating circuit according to claim 1, characterised in that the deactivation condition is raised with an increasing dimming level.

6. The operating circuit according to claim 1, characterised in that, when a given dimming level is undercut, the deactivation condition is reduced no further.

7. The operating circuit according to claim 1, characterised in that the reactivation condition is raised with an increasing dimming level.

8. The operating circuit according to claim 1, characterised in that when a given dimming level is undercut, the reactivation condition is reduced no further.

9. The operating circuit according to claim 1, characterised in that, below a given dimming level, the control unit (SR) interrupts the clocking of the first switch (S1) for a given period, wherein this period is lengthened with a decreasing dimming level.

10. The operating circuit according to claim 1, characterised in that, within a given dimming-level range, the control unit (SR) interrupts the clocking of the first switch (S1) for a given period, wherein this period is lengthened with a decreasing dimming level, and also, the deactivation condition is simultaneously lowered with a decreasing dimming level.

11. The operating circuit according to claim 1, characterised in that the control/regulation unit (SR) deactivates the first switch (S1,) When the current through the first switch (S1) exceeds a maximal reference value, and the deactivation condition is accordingly reached.

12. The operating circuit according to claim 1, characterised in that the reactivation condition is reached when the current through the LED during the free-wheeling phase reaches an activation-current value.

13. The operating circuit according to claim 1, comprising a control circuit (IC) which forms the control/regulation unit (SR) and comprises an input for detecting the reaching of the reactivation condition and/or the deactivation condition and controls the first switch (S1).

* * * * *